United States Patent [19]

Filbert et al.

[11] Patent Number: 4,933,216

[45] Date of Patent: Jun. 12, 1990

[54] DUAL-OVENABLE FOOD TRAYS WITH TEXTURED SURFACE

[75] Inventors: William C. Filbert, Wilmington, Del.; Ernst U. Bruns, Odessa, Canada

[73] Assignee: Du Pont Canada, Inc., Mississauga, Canada

[21] Appl. No.: 356,329

[22] Filed: May 23, 1989

[51] Int. Cl.[5] ..... E06B 3/24

[52] U.S. Cl. ..... 428/34.1; 426/113; 426/234; 426/524; 428/35.7; 428/36.92; 428/113; 428/141; 428/156; 428/167; 428/172; 428/178; 428/179; 428/180

[58] Field of Search ..... 426/524, 113, 234; 428/35.7, 36.92, 34.1, 141, 156, 167, 179, 172, 178, 180; 219/19.55 E

[56] References Cited

U.S. PATENT DOCUMENTS 4,740,377 4/1988 Dawes et al. ..... 426/234

FOREIGN PATENT DOCUMENTS 0266318 8/1988 European Pat. Off. .

*Primary Examiner*—Ellis P. Robinson
*Assistant Examiner*—J. Weddington

[57] ABSTRACT

A synthetic polymeric food tray having a surface with a pebbled texture, the indentations in the texture being at least 75 micrometers deep, the distances from the center of one pebble to another adjacent pebble being from 0.5 to 3.0 mm, and the surfaces of the pebbles being parallel to the general contour of the surface of the tray in the vicinity of the pebble being substantially flat or slightly rounded, exhibits reduced swarf formation.

20 Claims, No Drawings

DUAL-OVENABLE FOOD TRAYS WITH TEXTURED SURFACE

The present invention relates to an ovenable container, e.g. a tray. Ovenable trays are used in the prepackaged food industry. Usually food is placed on such trays, the trays are lidded and the lidded trays are placed in food refrigerators or freezers.

It is known to sell foods, e.g. meals, in lidded trays, to consumers with the intention that the food in the lidded trays may be heated or cooked in a conventional, convection oven or a microwave oven. Such trays are often known in the trade as dual-ovenable trays. Most commonly such dual-ovenable trays are made by thermoforming sheets of crystallizable polyethylene terephthalate. More recently, dual-ovenable trays have been made by injection moulding partially crystalline polyamides, or blends of partially crystalline polyamide and a compatibilized olefin-based polymer as disclosed, for example, in U.S. Pat. No. 4,740,377, which issued 1988 Apr. 26 to D. H. Dawes and E. L. Fletcher. It has been found that consumers like to keep the heated or cooked food in the trays and eat the food directly from the trays rather than transfer the food to plate or similar. It had also been found that there is a tendency for trays, made from a thermoplastic polymeric materials, to be gouged, with swarf formation, by serrated knives if sufficiently high pressure is applied to the knives. The possibility of slivers of the tray material being mixed with the food is undesireable. It is known that texturing of products made from thermoplastic and thermosetting polymeric materials helps to make such products mar and scratch resistant. For example, in European Patent publication No. 0 266 318, published 1988 May 4 to Monetti S.p.A., there is described a plastic food container which has its exterior textured with a slightly raised pattern in the form of intersecting segments in various orientations for preventing scratching such exterior. Notwithstanding such prior art it is believed that swarf formation on the interior of food trays caused by the action of serrated knives has not heretofore been addressed. A method for minimizing swarf formation by serrated knives has now been found.

Accordingly the present invention provides a synthetic polymeric food tray having a surface, which is intended to be in contact with food, and which has a pebbled texture, the indentations in the texture being at least 75 μm deep, the distances from the centre of one pebble to another adjacent pebble being from 0.5 to 3.0 mm, and the surfaces of the pebbles parallel to the general contour of the surface of the tray in the vicinity of the pebble being substantially flat or slightly rounded.

The present invention also provides a food package comprising food placed in a synthetic polymeric food tray having the surface, which is in contact with the food, which has a pebbled texture, the indentations in the texture being at least 75 μm deep and the distances from the centre of one pebble to another adjacent pebble being from 0.5 to 3.0 mm, and the surfaces of the pebbles parallel to the general contour of the surface of the tray in the vicinity of the pebble being substantially flat or slightly rounded.

In one embodiment the synthetic polymer is selected from the group consisting of (i) a nylon made from an aliphatic dicarboxylic acid and an aliphatic diamine, each having from 6 to 24 carbon atoms, (ii) a nylon made from an aliphatic aminoacid having from 6 to 24 carbon atoms, (iii) an amorphous nylon (iv) mixtures thereof, and (v) polyesters.

In another embodiment the synthetic polymer is a blend of partially crystalline polyamide, and a compatibilized olefin-based polymer in an amount of from 1 to 30 wt. % of the blend.

In a preferred embodiment the polyamide is selected from nylon 6 and nylon 66. Nylon 6 having an intrinsic viscosity (IV) in the range of 0.75 to 1.3 dl/g is useful. It is preferred that the intrinsic viscosity be in the range of 0.95 to 1.2 dl/g, particularly 1.0 to 1.1 dl/g. Intrinsic viscosity is measured at 25° C. in formic acid (85% acid to 15% water) by methods known in the art. An especially preferred polyamide is nylon 66 having a relative viscosity (RV) in the range of 25 to 250, particularly 40 to 85 and more particularly 45 to 60. Relative viscosity as shown herein is the ratio of viscosity at 25° C. of an 8.4 wt. % solution of nylon 66 in 90 wt. % formic acid (90% acid to 10% water) to the viscosity at 25° C. of the 90 wt. % formic acid alone. The polyamide may be a blend of polyamides, e.g., nylon 66 having a relative viscosity of 50 and nylon 66 having a relative viscosity of 200. The polyamide may also be a blend of different polyamides, e.g., nylon 6 and nylon 66.

In another embodiment the polyamide of the tray may also be blended with a modifying material selected from the group consisting of fillers, pigments, dyes and mixtures thereof. The polyamide may also contain small quantities of antioxidants, thermal stabilizers, lubricants, release agents, flow modifiers and the like. The specific modifying material chosen will depend on the end-use requirements.

Olefin-based polymer modifying materials tend to make the trays flexible and tough, and more suitable for microwave applications. The compatibilized olefin-based polymers may be olefin-based polymers having polar groups attached thereto which allow the olefin-based polymer and the polyamide to be blended without phase separation. Such compatibilized olefin-based polymers may be in the form of so-called graft copolymers. The compatibilized olefin-based polymers may also be mixtures of compatibilized olefin-based polymers, and olefin-based polymers which are incompatible with the polyamide. Examples of such incompatible polymers include homopolymers of ethylene or propylene, copolymers of ethylene and $C_4$ to $C_{10}$ alpha-olefins, polyisobutylene and poly(4-methylpentene-1). Examples of compatibilized olefin-based polymers include copolymers of ethylene and unsaturated carboxylic acid or ester monomers, e.g., ethylene/vinyl acetate copolymers, ethylene/methylacrylate copolymers, ethylene/ethylacrylate copolymers, ethylene/n-butylacrylate copolymers, ethylene/methacrylate copolymers, ethylene/methacrylic acid copolymers and partially neutralized ethylene/methacrylic acid copolymers (ionomers); hydrocarbon alpha-olefins grafted with unsaturated carboxylic acids or unsaturated anhydrides, e.g., ethylene/acrylate ester copolymer grafted with unsaturated carboxylic acids or unsaturated anhydrides, ethylene/vinyl acetate copolymers grafted with unsaturated carboxylic acids or unsaturated anhydrides, ethylene/$C_4$ to $C_{10}$ alpha-olefin copolymers grated with unsaturated carboxylic acids or unsaturated anhydrides, ethylene homopolymers grafted with unsaturated carboxylic acids or unsaturated anhydrides. The preferred unsaturated carboxylic acid or unsaturated anhydride are maleic acid and maleic anhydride. As indicated hereinbefore, such polyolefin materials must, of course, be compatible with the partially crystalline polyamides useful in this invention.

Useful concentrations of such olefin-based polymer modifying materials fall within the range of 1 to 30 wt. % of the blend, with 10 to 20 wt. % being preferred. Many of the olefin-based polymer modifying materials may be added to improve the toughness of the trays particularly at low temperatures, e.g., polyethylene grafted with maleic anhydride, or to improve impact resistance, e.g., ethylene/methacrylic acid copolymers. With incompatible olefin-based polymers, it is necessary to also add small quantities of a compatibilized olefin-based polymer. For example, small amounts of ionomer, e.g., up to about 5 wt. % of the blend, may be added in order to assist in compatibilizing the polyolefin and polyamide. For convenience, however, a graft copolymer as the sole compatibilized olefin-based polymer is preferred.

Ionomer modifying materials in amount of 1 to 30 wt. % of the blend tend to make the injection moulded trays flexible and tough, properties which are especially important at low temperatures. Zinc ionomers are preferred. However, at high temperatures, e.g., about 230° C., such trays tend to become less rigid and hence they tend to be more suitable for microwave cooking or lower temperature cooking in conventional ovens. Stiffness of such ionomer-modified trays may be improved by addition of inorganic mineral or siliceous fillers, e.g., talc, glass bubbles, glass beads, glass fibres, kaolin and mica.

Suitable fillers include fibrous inorganic fillers, e.g., glass fibres; fibrous organic fillers, e.g., aramid fibres; powdered fillers, e.g., kaolin, fused quartz, calcium carbonate; siliceous fillers, e.g., glass beads, hollow glass spheres; and lamellar fillers, e.g., talc, mica. The lamellar fillers are preferred for improving the heat distortion characteristics of the injection moulded trays. However the lamellar fillers tend to make trays made therewith easier to gouge with a knife, and to form swarf when a serrated knife is used. The lamellar filler particles, if present, should preferably have a largest dimension (hereinafter referred to as "diameter") of less than about 150 μm and a minimum particle diameter to particle thickness ratio (otherwise referred to as the aspect ratio) of about 20:1. It is preferable that the aspect ratio be as large as practical, e.g., as large as 50:1 to 100:1. Wet ground mica is the preferred lamellar filler, having a mesh size between 60 and 325 U.S. sieve, particularly between 200 and 325 U.S. sieve. Suitable grades of mica are sold under the trade marks ALSIBRONZ 12 and HUBER WG-1. Talc is preferred for light-coloured trays. The fillers may be added in amounts of 1 to 40 wt. % of the blend, preferably in amounts of 10 to 30wt. %.

In addition, pigments or dyes may be added for aesthetic effect. In particular, titanium dioxide may be added for opacity. Other pigments may be added for their colour appeal. Antioxidants, e.g., 1,3,5-trimethyl-2,4,6-tris(3,5-di-tertbutyl-4-hydroxybenzyl)benzene, heat stabilizers, e.g., copper salts, processing aids and the like may also be added as are known in the art.

In a preferred embodiment the indentations in the texture are at least 150 μm deep, especially from 150 to 200 μm deep.

In another embodiment the distances from the centre of one pebble to another adjacent pebble are from 0.5 to 2.0 mm.

In another embodiment the surfaces of the pebbles parallel to the general contour of the surface of the tray in the vicinity of the pebble are substantially flat on the crown of each pebble and rounded at the edges of each pebble.

It is also preferred that the tray thickness be in the range of 0.38 to 1.00 mm. The tray may have stiffening ribs along the floor of the tray provided that the thickness of the ribs does not exceed 1.6 mm.

The tray may also have a peripheral shaped lip, the purpose of which is to provide a means for attaching a lid to the tray and/or to stiffen the tray. Attachment of the lid may be by mechanical means, e.g., crimping, or by other means, e.g., adhesive attachment. The peripheral shaped lip, if present, may be thicker than other parts of the tray but must not exceed 1.6 mm in thickness. The shape of the lip may be any one of known forms. The tray may also be compartmentalized in order to separate different kinds of food, for example in a two-compartment tray, meat may be in one compartment and vegetables in the other. The compartments may be formed using walls within the tray. Alternatively, the tray may be formed in such a way that each compartment is, in itself, a tray and adjacent compartments are joined only at the lip of the walls of the tray. The latter construction of the tray is more expensive to produce because, in essence, there are two walls between adjacent compartments rather than one, as in the former construction.

The tray may be injection moulded or thermoformed by known methods. It will be appreciated by those skilled in the art that it is structurally advantageous for the floor and walls of the tray to be joined smoothly, with "curved corners".

The selection of thickness of the tray depends in part upon the size of the tray and in part upon the composition of the material from which the tray is injection moulded. Merely from a structural standpoint, it will be clear that, for a given composition and tray design, the thicker the tray the stiffer and tougher will be the tray. It will also be appreciated, however, that the thicker the tray, the heavier and more costly to produce it will be.

The pebbled texture is most economically formed during the injection moulding process as is known by those skilled in the art.

After injection moulding and forming the pebbled surface thereon, the trays are filled with food. Most often, the food consists of an entree comprising meat and one or more vegetables. The food-filled trays may then be lidded in a conventional manner and the resultant packaged, either refrigerated or frozen. The lids may be rigid, e.g. made from thermoformed crystalline polyethylene terephthalate, so that the filled food trays may be stacked, whether packaged in card boxes or not. Alternatively, in order to minimize the "head space" above the food, the lid may be made of film and the food vacuum packed. For the latter process, a piece of film may be located above the food-containing tray, the film heated in order to soften it and then lowered onto the tray while simultaneously providing a vacuum beneath the tray such that the vacuum pulls the film into intimate contact with the rim and the outer sides of the walls of the tray. The film is then cooled, allowing the outer edges of the film to set around the rim and walls to form a permanently set lid with a vacuum-induced thermally-set crimp.

The refrigerated or frozen food package is transported to grocery shops, supermarkets or the like for storage and display in freezer or refrigerator cabinets. After sale, the consumer may cook the food in a conventional oven or microwave oven, usually after removing, or perforating the lid. The required heating or cooking time may be found by simple experimentation.

The present invention is illustrated by reference to the following examples.

EXAMPLE 1

A number of trays were injection moulded using a blend of 71.8 wt. % nylon 66 having a relative viscosity of 42, 25.0 wt. % HUBER ASPRAFLEX 100 (trade marks) mica, 3.0 wt. % TI-PURE (trade mark) titanium dioxide and 0.2 wt. % zinc stearate. Trays, 0.89 mm thick and 19.7 cm in diameter by 17.8 mm deep were injection moulded using a TOSHIBA (trade mark) 390 ton injection moulding machine.

In one series of experiments, the mould for the injection moulded trays was etched so that the inner floor of the tray would have a patterned surface according to MOLD-TECH (trade mark) pattern MT1244. The indentations in the texture were about 75 μm deep. The pebbles of the texture were randomly sized, with the distances from the centre of one pebble to adjacent pebbles being from 0.2 to 1.0 mm. The surfaces of the pebbles parallel to the general contour of the floor of the tray were substantially flat with rounded corners.

In a second series of experiments, the mould for the injection moulded trays was etched so that the inner floor of the tray would have a patterned surface according to MOLD-TECH (trade mark) pattern MT1077. The indentations in the texture were about 100 μm deep. The pebbles of the texture were randomly sized, with the distances from the centre of one pebble to adjacent pebbles being from 0.5 to 1.5 mm. The surfaces of the pebbles parallel to the general contour of the floor of the tray were substantially flat with rounded corners.

In a third series of experiments, the mould for the injection moulded trays was etched so that the inner floor of the tray would have a patterned surface according to MOLD-TECH (trade mark) pattern MT1015. The indentations in the texture were about 150 μm deep. The pebbles of the texture were randomly sized, with the distances from the centre of one pebble to adjacent pebbles being from 0.5 to 1.5 mm. The surfaces of the pebbles parallel to the general contour of the floor of the tray were substantially flat with rounded corners.

For comparison purposes a further series of trays were moulded without any texturing of the floor of the trays. In the Table below these trays are identified as NOTEX.

All of the trays were subjected to a test in which a serrated metal knife, having 20 serrations per 2.54 cm, was drawn across the floor of the tray at a pressure of 26.6 N. The results of the tests are shown in Table I.

TABLE I

| Tray Type | Comments |
|---|---|
| NOTEX | Tray floor gouged, producing plastic swarf from 2.5 mm to 12.5 mm long |
| MT1244 | Tray floor gouged, producing plastic swarf from 2.5 mm to 12.5 mm long |
| MT1077 | Tray floor gouged, producing plastic swarf from 2.5 mm to 8.0 mm long |
| MT1015 | Tray floor gouged slightly, producing no plastic swarf. |

At the applied pressure of 26.6 N it was found that the knife gouged the trays to a depth of about 125 μm and that at depths of indentation of 150 μm there was no swarf produced. Indeed, as long as the depths of gouging were less than the depths of indentation of the pebbled surface there was no swarf produced. At lower depths of the indentations, e.g., 75 to 100μ, swarf could be substantially eliminated by lessening the applied pressure to the knife.

NOTEX and MT1244 are outside the scope of the present invention. NOTEX is included as being representative of the the prior art.

As can be seen from the above, the objectionable plastic swarf has been substantially reduced when the surface of the tray, which is in contact with the food, is textured in the manner claimed.

We claim:

1. A synthetic polymeric food tray having a surface, which is intended to be in contact with food, and which has a pebbled texture of outwardly extending pebbles surrounded by inwardly directed indentations, the indentations in the texture being at least 75 μm deep, the distances from the centre of one pebble to another adjacent pebble being from 0.5 to 3.0 mm, and the surfaces of the pebbles parallel to the general contour of the surface of the tray in the vicinity of the pebble being substantially flat or slightly rounded, said pebbled texture serving to minimize swarf formation when said surface is gouged with a serrated knife.

2. A synthetic polymeric food tray according to claim 1 wherein the synthetic polymer is selected from the group consisting of (i) a nylon made from an aliphatic dicarboxylic acid and an aliphatic diamine, each having from 6 to 24 carbon atoms, (ii) a nylon made from an aliphatic aminoacid having from 6 to 24 carbon atoms, (iii) an amorphous nylon (iv) mixtures thereof, and (v) polyesters.

3. A synthetic polymeric food tray according to claim 1 wherein the synthetic polymer is a blend of partially crystalline polyamide, and a compatibilized olefin-based polymer in an amount of from 1 to 30 wt. % of the blend.

4. A synthetic polymeric food tray according to claim 2 wherein the polyamide is selected from nylon 6 and nylon 66.

5. A synthetic polymeric food tray according to claim 1 wherein the tray contains up to 40 wt. % of a filler, such filler being selected from fibrous inorganic fillers, fibrous organic fillers, powdered fillers, siliceous fillers, and lamellar fillers.

6. A synthetic polymeric food tray according to claim 5 wherein the filler is a lamellar filler selected from mica and talc.

7. A synthetic polymeric food tray according to claim 1 wherein the indentations in the texture are at least 150 μm deep.

8. A synthetic polymeric food tray according to claim 6 wherein the indentations in the texture are from 150 to 200 μm deep.

9. A synthetic polymeric food tray according to claim 7 wherein the distances from the centre of one pebble to another adjacent pebble are from 0.5 to 2.0 mm.

10. A synthetic polymeric food tray according to claim 1, wherein the surfaces of the pebbles parallel to the general contour of the surface of the tray in the vicinity of the pebble are substantially flat on the crown of each pebble and rounded at the edges of each pebble.

11. A food package comprising food placed in a synthetic polymeric food tray having the surface, which is in contact with the food, which has a pebbled texture, the indentations in the texture being at least 75 μm deep and the distances from the centre of one pebble to another adjacent pebble being from 0.5 to 3.0 mm, and the surfaces of the pebbles parallel to the general contour of the surface of the tray in the vicinity of the pebble being substantially flat or slightly rounded.

12. A synthetic polymeric food tray according to claim 11 wherein the synthetic polymer is selected from the group consisting of (i) a nylon made from an aliphatic dicarboxylic acid and an aliphatic diamine, each having from 6 to 24 carbon atoms, (ii) a nylon made from an aliphatic aminoacid having from 6 to 24 carbon atoms, (iii) an amorphous nylon (iv) mixtures thereof, and (v) polyesters.

13. A synthetic polymeric food tray according to claim 11 wherein the synthetic polymer is a blend of partially crystalline polyamide, and a compatibilized olefin-based polymer in an amount of from 1 to 30 wt. % of the blend.

14. A synthetic polymeric food tray according to claim 12 wherein the polyamide is selected from nylon 6 and nylon 66.

15. A synthetic polymeric food tray according to claim 11 wherein the tray contains up to 40 wt. % of a filler, such filler being selected from fibrous inorganic fillers, fibrous organic fillers, powdered fillers, siliceous fillers, and lamellar fillers.

16. A synthetic polymeric food tray according to claim 15 wherein the filler is a lamellar filler selected from mica and talc.

17. A synthetic polymeric food tray according to claim 11 wherein the indentations in the texture are at least 150 μm deep.

18. A synthetic polymeric food tray according to claim 16 wherein the indentations in the texture are from 150 to 200 μm deep.

19. A synthetic polymeric food tray according to claim 17 wherein the distances from the centre of one pebble to another adjacent pebble are from 0.5 to 2.0 mm.

20. A synthetic polymeric food tray according to claim 11 wherein the surfaces of the pebbles parallel to the general contour of the surface of the tray in the vicinity of the pebble are substantially flat on the crown of each pebble and rounded at the edges of each pebble.

* * * * *